US005888004A

United States Patent [19]

Bouix

[11] Patent Number: 5,888,004

[45] Date of Patent: Mar. 30, 1999

[54] CUP WITH A GROOVED INTERIOR SIDE WALL FOR HOLDING A COSMETIC STICK

[75] Inventor: Hervé Bouix, Marty Le Roi, France

[73] Assignee: L'Oreal, Paris, France

[21] Appl. No.: 882,532

[22] Filed: Jun. 26, 1997

[30] Foreign Application Priority Data

Jun. 26, 1996 [FR] France ..... 96 07946

[51] Int. Cl.[6] ..... A45D 40/06

[52] U.S. Cl. ..... 401/87; 401/68; 401/75; 401/88; 401/98

[58] Field of Search ..... 401/75, 87, 98, 401/78, 68, 88

[56] References Cited

U.S. PATENT DOCUMENTS

| | | | |
|---|---|---|---|
| 1,579,103 | 3/1926 | Gerow | 401/98 |
| 2,349,800 | 5/1944 | Lee | 401/98 |
| 3,333,689 | 8/1967 | Terrill et al. . | |
| 4,770,556 | 9/1988 | Ackermann et al. . | |
| 5,277,508 | 1/1994 | Gueret | 401/87 |

FOREIGN PATENT DOCUMENTS

| | | |
|---|---|---|
| 182 655 | 5/1986 | European Pat. Off. . |
| 2548880 | 1/1985 | France . |
| 2 662 921 | 12/1991 | France . |

*Primary Examiner*—Steven A. Bratlie
*Attorney, Agent, or Firm*—Young & Thompson

[57] ABSTRACT

A stick holder cup (3) intended to be slidably mounted in a case (1) includes a closed transverse bottom (31) for supporting a stick of solid product liable to crumble. A cylindrical sidewall (32) of the cup is joined to this bottom, and the cup is moved axially by drive (33). The cylindrical sidewall has at least one axial microgroove (34) for creating an air escape route when the stick of the product is being positioned in the cup.

23 Claims, 2 Drawing Sheets

CUP WITH A GROOVED INTERIOR SIDE WALL FOR HOLDING A COSMETIC STICK

The present invention relates to a stick holder cup, in particular for a product for the lips, presented in the form of a solid stick. The invention also relates to a case comprising such a cup. This solid stick is, for example, a stick of a colored or non-colored product for the lips, or a dermatological stick for the selective treatment of certain portions of affected skin or the lips. More particularly, the invention may provide a cup for a stick having volatile constituents, such as cyclic or linear volatile silicones.

Lipstick cases have been in general use for about fifty years and are known under the name of "lipsticks".

Generally, such a lipstick has a tubular shell in which there is mounted a stick holder cup capable of sliding axially in the shell, the bottom of the solid product liable to crumble being engaged in the cup. In the conventional way such a lipstick case also has manipulating means, for example a rotating knurled wheel, by means of which the user can make the cup slide in the shell, to cause the stick to emerge or retract as desired.

The product which is liable to crumble contains, amongst other constituents, waxes, fatty substances and pigments. The forming of such a product is effected by casting the mixture of various constituents in a hot state in an appropriate mold. After cooling, the stick is taken out of the mold and positioned in the cup. This last operation is difficult because of the mechanical fragility of the stick.

Various solutions have been proposed for ensuring a suitable hold of the stick in the cup, for example as disclosed in FR-A-2 548 880 which describes how the stick is held in position in the cup by means of resilient tongues which form part of the cup. These tongues ensure a satisfactory hold of the stick on condition that the stick is quite solid and but only slightly deformable.

Now recently, developers of formulations for lip products have been using new raw materials, for example, volatile silicones. The use of these products is advantageous since, with them, it is possible to obtain a make up of the lips that is long lasting as compared with conventional lipsticks. Moreover, a lipstick with silicones makes the make-up of the lips particularly glossy and the color of the pigments appears more intense than with a conventional stick. Furthermore, the deposited product layer has the advantage of quickly drying out by evaporation of these volatile silicones, after application to the lips.

In spite of the above mentioned advantage, a lipstick with volatile silicones has various drawbacks. In particular, because of the evaporation of these volatile constituents, a stick with silicones rapidly deteriorates on contact with air; it hardens, which renders the product unusable. Moreover, this product assumes an unsightly appearance.

One solution of this problem, which has been proposed in EP-A-0 182 655, lies in a case for protecting the stick against drying out and provided with sealing means intended to reduce this evaporation. However, because of the presence of these volatile silicones, the stick containing them is softer than a conventional stick. The result is that the manipulation of this stick is more difficult, in particular as regards its positioning in a stick holder cup with which the case is provided.

In general, the positioning of a lipstick in a cup is effected by using a cup with a pierced bottom, to avoid a piston-type effect which does not allow the stick to be correctly positioned in the cup and to be properly held in position in the cup. Indeed, in the presence of this piston-type effect it is not possible to place the bottom of this stick into contact with the bottom of the cup since an air cushion is formed between the stick and the bottom. Now a cup with an open bottom cannot be used for a stick with volatile constituents, because evaporation will take place through the open bottom of the cup, with the result that the bottom of the stick dries out and there is a risk of causing the stick to drop out of the cup.

Furthermore, because of the soft consistency of a stick with volatile silicones and of the lubricating properties of the silicones, it is difficult to ensure the hold of the stick in the cup, in particular when the case is carried, for example in a handbag, where there is the risk that the smallest shock will detach the stick from the cup.

The object of the present invention is to remedy all these above mentioned drawbacks by proposing a cup for a case for lipstick in stick form, in particular with volatile silicones in which an evaporation of the silicones is reduced or even avoided, avoiding the detachment of the stick from the cup, while ensuring, moreover, an easy positioning and reliable hold of the stick in the cup.

Another object of the invention is to propose a cup that can be made in a simple way and is inexpensive and which permits, moreover, an industrial positioning of the stick in the cup irrespective of the composition of the stick.

Thus a first aspect of the invention relates to a stick holder cup intended to support a stick of a solid product liable to crumble, the cup having an axis of symmetry and comprising a closed transverse bottom and a side wall joined to this bottom, characterized in that the cup has means in its side wall for preventing the formation of an air cushion between the bottom of the cup and the stick as the stick is being positioned in the cup.

More particularly, these means for preventing the formation of an air cushion are constituted by one or several microgrooves in the internal side wall of the cup and intended to create an air escape route when the stick is being positioned in the cup.

Preferably, these microgrooves of the cup extend over the whole height of the side wall.

Advantageously, these microgrooves are four in number, uniformly distributed around the whole circumference of the internal side wall of the cup, the orientation of the microgrooves being substantially parallel to the axis of the cup. Thus during the positioning of the stick in the cup, the air can escape from the cup and any piston-type effect is avoided. Such a microgroove may, for example, have a depth of approximately 0.2 mm and a width of approximately 2 mm. Generally, the cup has a cylindrical, oval or prismatic shape. Most frequently, a cylindrically shaped cup is preferred.

A second aspect of the invention relates to a case containing a stick of a solid product liable to crumble, comprising a cup in accordance with the first aspect and provided with an axis, and with drive means capable of causing the cup to slide in the case along this axis for causing the product stick to return into its case or to emerge from its case, as desired.

The use of such a cup with a closed bottom makes it possible to prevent the drying out of the bottom of the stick.

The cup with its microgroove is perfectly suitable for a stick containing volatile constituents, for example volatile silicones, although it can be used with other stick types. In order to prevent the drying out of the stick when volatile silicones are present it is, moreover, preferable to provide sealing means to prevent the volatile silicones from escaping. Moreover, it is preferable to keep the stick with volatile silicones in an environment saturated with vapors (of these silicones). Thus the case may have a cap, capable of closing the outer shell, fitted on the sleeve. Advantageously, this cap has first sealing means capable of being applied in a leakproof manner against the outer side of the sleeve. Thus the volatile constituents are prevented from escaping from the stick through the case into the atmosphere. Advantageously, these first sealing means are constituted by one or several annular beads made of a resilient material. It is desirable to form the cap in such a way as to define a small volume for the vapors.

To ensure the fixing of the stick in the cup, the internal side wall may carry one or several elements projecting towards the inside of the cup, for example, in the form of projecting ribs, with an orientation substantially parallel to the axis of the cup. These ribs improve the attachment of the bottom of the stick in the cup.

Preferably, the case has a base and the sleeve, the sleeve being secured against translation and movable in rotation relative to the bottom of the case. This sleeve has first and second open ends. Its first end constitutes an outlet opening for the emergence of the stick. Moreover, the second end is preferably joined to a holding element preventing the rotation of the stem of the cup, but permitting its translation in the sleeve. For this purpose, the stem may advantageously comprise one or two half-flats extending over the whole of its length, so that the stem has a substantially oval cross-section. In this case, the element which prevents the rotation of the stem is provided with an opening with a cross-section complementary to the cross-section of the stem, for example, an oval cross-section.

Advantageously, the cup has, moreover, first means for driving the cup, for example, a central stem joined to the bottom of the cup, carrying an external thread. The side wall of the cup and the stem are situated on either side of the bottom of the cup. This stem cooperates with second drive means, carried by the case, to cause the cup to slide in the sleeve of the case along the axis of the cup.

The second drive means may be joined to the bottom of the case. They comprise, for example, a sleeve provided with an internally threaded bore, the thread of the sleeve being capable of cooperating with the thread of the stem.

It will be understood that by causing the sleeve to rotate relative to the outer shell of the case, the cup can be caused to slide in the sleeve and can thus cause the stick to emerge from, or retract into the case as desired.

In accordance with the invention, second sealing means are moreover provided between the sleeve and the cup. These second means are constituted for example by one or several annular external beads intended to come into a leakproof contact with the sleeve of the case surrounding the cup. As compared with a conventional lipstick case, it is thus possible to reduce the escape of volatile constituents out of the case, which constituents may be contained in the stick.

The sleeve is matched to the shape of the cup. It has, in particular, a cylindrical shape for a cylindrical cup.

To render the present invention more readily understood, one embodiment of a lipstick case fitted with a cup in accordance with the invention, will be described below with reference to the attached drawings.

FIG. 1 shows an axial sectional view of a lipstick case, provided with a stick holder cup in accordance with the invention.

FIG. 2 a shows a cross-sectional view along plane II—II of FIG. 1.

Figure 1:
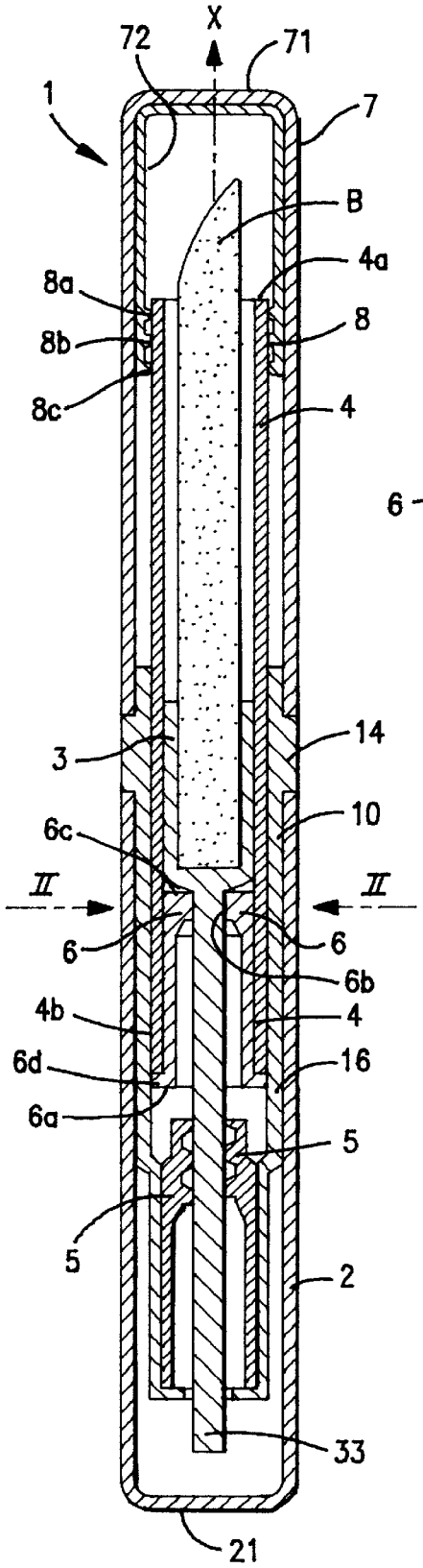
Figure 2:
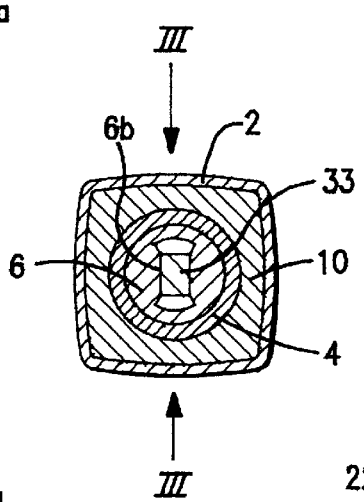
Figure 4:
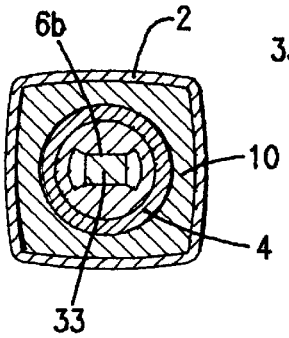
FIG. 4 shows a cross-sectional view along plane IV—IV of FIG. 3.
Figure 3:
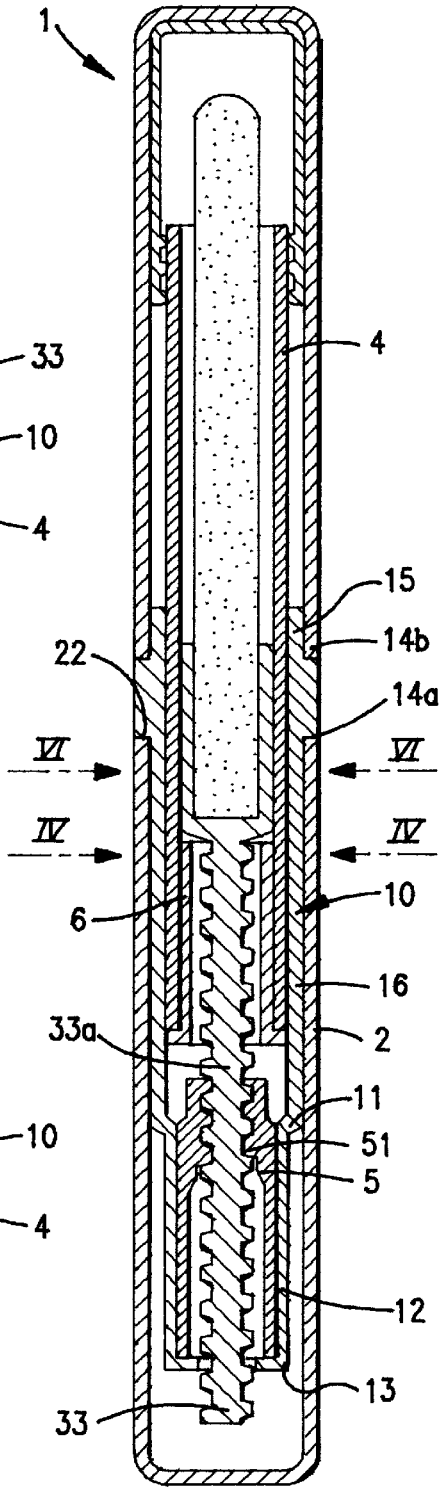
FIG. 3 shows an axial sectional view along plane III—III of FIG. 1.
Figure 5:
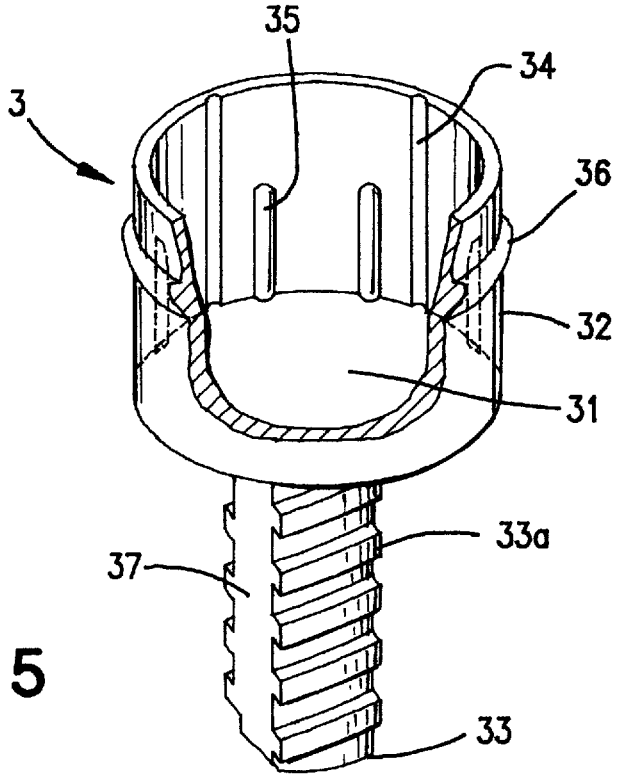
FIG. 5 is an enlarged view in perspective of the cup mounted in the case of FIG. 1, with some portions having been stripped.
Figure 6:
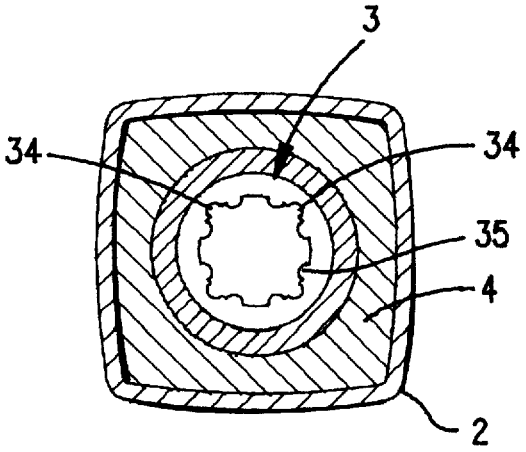
FIG. 6 shows a cross-sectional view of the case of FIG. 1 along plane VI—VI of FIG. 3.

Referring to FIGS. 1 to 6, there may be seen a case 1 which comprises a lipstick B containing volatile constituents, comprising an outer protective shell 2, for example, a metal shell. The case is provided with a central axis X and has a substantially square cross-section with rounded corners. The shell 2 is provided with a closed bottom 21 and an open end 22.

A cylindrical intermediate sleeve 10 is fixedly fitted in the outer shell 2 and has a central portion 16 extending towards the bottom 21 over two thirds of the height of the shell 2. The sleeve 10 is provided with a shoulder 11 towards its end nearer the bottom of the case.

To this shoulder 11 is joined a cylindrical extension 12 with a smaller cross-section than that of the sleeve 10. The free end of this extension 12 ends in the vicinity of the bottom 21 in a flange 13 radially bent towards the axis X.

On the end remote from the bottom 21, the sleeve 10 has a zone 14 of greater thickness whose external dimension corresponds to the external cross-section of the shell 2. Thus the zone 14 forms first and second stops 14*a* and 14*b*, whereof the first 14*a*, nearer the bottom 21 of the shell bears against the free end 22 of the shell 2. A duct 15 extends away from the second stop 14*b* to the side remote from the first stop 14*a*. In combination with the duct 15, the stop 14*b* forms a seat for a protective cap 7, advantageously made of metal, with the same cross-section as that of the shell 2. This cap has a closed end 71, wherein there is force fitted an undercap 72 made of a semirigid thermoplastic material. This undercap 72 is provided with a free end 8 ending at approximately two thirds of the height of the cap. The internal side of the end 8 is provided with three annular beads 8*a*, 8*b*, 8*c* whose function will be explained below.

A holding element 6 is fitted in the intermediate sleeve 10. This element is cylindrical and has two ends 6*a*, 6*c*; the first end 6*a* nearer the bottom 21 of the case has an internal radial extension 6*d* which is fixed, for example by bonding or force fitting, in a portion of the intermediate sleeve 10 in the vicinity of the shoulder 11. Thus a cylindrical space is defined between the sleeve 6 and the intermediate sleeve 10. The second end 6*c* has a bead 6*b* defining an opening of a substantially oval shape whose function will be explained below.

In the cylindrical space between the sleeve 6 and the sleeve 10, there is disposed, free for rotation but fixed against translation, a cylindrical sleeve 4 whose outer diameter is slightly smaller than the internal diameter of the central portion 16 of the intermediate sleeve 10 and whose internal diameter is slightly greater than the outer diameter of the holding element 6. This sleeve 4 extends from the radial extension 6*d* beyond the beads 8*a*, 8*b*, 8*c* of the undercap 72. Thanks to the beads 6*a*, 6*b*, the inside of the sleeve 4 is insulated from the ambient air and any escape of the solvent present in the case into the atmosphere is prevented and the stick B is thus prevented from drying out.

A cup 3 movable in axial translation is disposed in the sleeve 4. This cup has a circular bottom 31 (see FIG. 5) to which there is joined a cylindrical side wall 32. The bottom 31 of the cup 3 has, moreover, a central stem 33 such that the wall 32 and the stem 33 extend in opposite directions on either side of the bottom 31 of the cup. The stem 33 is provided over its whole length with two half-flats 37. It is provided with an external thread 33*a* and forms first means for driving the cup, this thread 33*a* being capable of cooperating with an internal thread 51 of a tubular member 5 constituting second drive means. The tubular member 5 is force fitted in the extension 12 of the sleeve 10 and rests on the flange 13.

The stem 33 of the cup passes through the oval opening at bead 6*b* of the holding element 6. Thus, the stem 33 can be displaced axially in translation in the holding sleeve 4, its rotation being prevented by the shape of the stem and of oval opening respectively. From the description given above, it will that by causing the shell 2 (and hence the sleeve 10 and the tubular member 5 which are integral therewith) to rotate relative to the sleeve 4, the cup 3 can be caused to slide in the sleeve 4 as desired.

Advantageously, the cup 3 is made of a semirigid material such as polypropylene. Its substantially cylindrical side wall 32 has an external peripheral sealing ring 36 capable of being applied in a leakproof manner against the internal wall of the sleeve 4. When the cup is mounted in the sleeve 4 (see FIG. 1) leakage of the solvents present in the stick, in the direction towards the space situated above the bottom 21, is thus prevented.

According to the invention, the internal face of the side wall 32 has axial microgrooves 34, here four in number, over the entire height of the cup and regularly interspaced from one another. Thanks to the presence of these microgrooves, the stick B can be mounted in the cup 3 by a conventional industrial tool, without risking the formation of an air cushion between the cup bottom 31 and the base of the stick B of the product.

On the inside, the cylindrical side wall 32 of the cup has axial ribs 35 for fixing the stick B. As may be seen in FIG. 6, these ribs 35 are 8 in number. During the mounting of the stick B in the cup, these ribs enter into the bottom of the stick, reinforcing the hold of the stick in the cup.

This manner of mounting the stick B in the cup only requires a moderate force for gripping the stick by the tools, without the risk of damaging the stick. This arrangement is suitable, in particular for the mounting of a stick of a relatively soft consistency, for example of a stick containing volatile silicones.

I claim:

1. A stick holder cup (3) intended to support a stick (B) of a solid product liable to crumble, said cup having an axis (X) and comprising a closed transverse bottom (31) and a side wall (32) joined to this bottom (31), characterized in that the side wall (32) has internally at least one substantially axial microgroove (34) intended to create an air escape route as the stick (B) is being positioned in the cup (3).

2. A cup (3) according to claim 1, wherein said microgroove (34) extends over the whole height of the side wall (32)

3. A cup (3) according to claim 1, comprising a plurality of said microgroove (34).

4. A cup (3) according to claim 1, comprising four of said microgroove.

5. The cup of claim 1, wherein said at least one microgroove comprises plural channels each having a bottom and sides that are coaxial with the axis of the cup.

6. A cup with an axis for holding a cosmetic stick, the cup comprising:

a closed transverse bottom;

a side wall for holding a cosmetic stick, said side wall being joined to and completely enclosing a periphery of said bottom and having an undivided exterior surface; and an interior surface of said side wall having at least one channel therein for venting air from said bottom to a top of said side wall when the cosmetic stick is being inserted into the cup, said at least one channel having a bottom and sides that are coaxial with the axis of the cup.

7. A cup (3) according to claim 6, wherein said side wall (32) has a generally cylindrical shape.

8. A cup (3) according to claim 6, wherein said side wall (32) comprises at least one inwardly projecting element (35) for holding the stick (B).

9. A cup (3) according to claim 8, wherein the at least one inwardly projecting element is an axial rib (35).

10. A cup (3) according to claim 6, wherein side wall (32) comprises at least one external sealing bead (36) for contacting in a leakproof manner a sleeve (4) surrounding the cup (3).

11. A cup (3) according to claim 10, further comprising drive means (33) for causing the cup to slide in the sleeve (4).

12. A cup (3) according to claim 11, wherein said drive means comprises a central stem (33) with an external thread (33*a*) joined to the bottom (31) of the cup, the stem (33) and the side wall (32) of the cup being situated on opposite surfaces of the bottom (31) of the cup.

13. A cup (3) according to claim 12, wherein the threaded stem (33) has at least one half-flat (37).

14. A cosmetic case comprising:

a stick of cosmetic;

cup for holding said stick therein, said cup having an axis;

drive means for causing said cup and said stick therein to slide in the case along said axis of said cup;

said cup comprising, a closed transverse bottom, a side wall for holding a cosmetic stick, said side wall being joined to and completely enclosing a periphery of said bottom and having an undivided exterior surface, and an interior surface of said side wall having at least one channel therein for venting air from said bottom to a top of said side wall when said stick is being inserted into the cup, said channel having a bottom and sides that are coaxial with the axis of the cup.

15. A case according to claim 14, wherein said drive means comprise first means (33) joined to the cup (3), and second drive means (5) carried by the case and cooperating with the first means.

16. A case according to claim 15, wherein said first means comprise a stem (33) with an external thread (33*a*).

17. A case according to claim 16, further comprising a cylindrical sleeve (4) having a first end (4*a*) and a second end (4*b*) fixedly mounted against translation and movable in rotation, the cup sliding in said sleeve (4) and a holding element for holding the stem, wherein the first end (4*a*) comprises an opening for emergence of the stick, and the second end (4*b*) is joined to said holding element (6).

18. A case according to claim 16, wherein said second drive means (5) comprises a tapped bore (51) for cooperating with the thread (33*a*) of the stem (33).

19. A case according to claim 15, further comprising an outer shell (2) with a closed bottom (21) carrying the second drive means (5) and wherein said second drive means (5) are fixed relative to the outer shell (2).

20. A case according to claim 19, further comprising a cap (7) for closing the outer shell (2).

21. A case according to claim 20, wherein the cap (7) has sealing means (8) for being applied in a leakproof manner against an outer side of the cylindrical sleeve (4).

22. A case according to claim 21, wherein the sealing means (8) comprise at least one annular bead (8*a*, 8*b*, 8*c*).

23. A case (1) according to claim 14, wherein said stick comprises at least one volatile constituent.

* * * * *